United States Patent [19]

Sonobe et al.

[11] 4,269,887

[45] May 26, 1981

[54] CERAMIC FIBER FELT

[75] Inventors: Kazuo Sonobe, Aichi; Takeo Kato, Toyokawa, both of Japan

[73] Assignee: Isolite Babcock Refractories Co., Ltd., Aichi, Japan

[21] Appl. No.: 39,969

[22] Filed: May 17, 1979

[30] Foreign Application Priority Data

Nov. 24, 1978 [JP] Japan ..... 53-145862

[51] Int. Cl.[3] ..... D04H 1/08; D04H 1/10

[52] U.S. Cl. ..... 428/280; 13/35; 428/288; 428/297; 428/299; 428/303; 162/145; 162/149; 162/164 R; 162/181 A

[58] Field of Search ..... 428/280, 281, 283, 288, 428/290, 297, 298, 302, 303, 325, 299; 13/35; 264/30

[56] References Cited

U.S. PATENT DOCUMENTS

| | | | |
|---|---|---|---|
| 2,917,426 | 12/1959 | Bugosh | 428/297 |
| 3,395,068 | 7/1968 | Rey | 428/302 |
| 3,701,701 | 10/1972 | Sogi | 428/297 |
| 3,708,317 | 1/1973 | Owen | 428/408 |
| 3,914,490 | 10/1975 | Fusick | 428/302 |

*Primary Examiner*—James J. Bell
*Attorney, Agent, or Firm*—A. W. Breiner

[57] ABSTRACT

A ceramic fiber felt is obtained by mixing alumina crystalline ceramic fibers having at least about 60 weight percent of $Al_2O_3$, the rest being $SiO_2$ and impurities, and having a filament length ranging from 10 to 30 mm with aluminosilicate non-crystalline ceramic fiber having from about 40 to 70 weight percent of $Al_2O_3$, the rest being primarily $SiO_2$, impurities, and, optionally, including a small amount of metal oxides, and having a filament length ranging from 5 to 30 mm, the weight proportions of the alumina crystalline ceramic fibers to the aluminosilicate non-crystalline ceramic fiber being from about 4:6 to 7.5:2.5, and preferably from about 4:6 to 5:5, and binding the mixture of components with an organic binder.

The ceramic fiber felt having a linear percentage shrinkage at 1400° C. of only about 2% is very inexpensive compared to alumina ceramic fiber and is highly suited for use as or in furnace linings.

9 Claims, 3 Drawing Figures

CERAMIC FIBER FELT

This application is related to copending application Ser. No. 040,057 filed concurrently herewith entitled "Method Of Making Improved Ceramic Blanket" in the names of Kazuo Sonobe and Takeo Kato and assigned to the assignee of the present application. The disclosure of the aforesaid application is incorporated herein by reference.

FIELD OF THE INVENTION

This invention relates to ceramic fibers primarily for use in lining the walls of various high-temperature furnaces.

DESCRIPTION OF THE PRIOR ART

Aluminosilicate ceramic fiber is widely used in the fabrication of various products. The prior art ceramic fiber is non-crystalline fiber mainly composed of about 40 to 70% by weight (hereinafter % means percent by weight unless otherwise stated) of $Al_2O_3$ and 30 to 60% of $SiO_2$ and containing a small quantity of metal oxides as an impurity or as an additional component. When using blankets or mats of such ceramic fibers as a lining material for a furnace, either in a "flat lining" wherein fiber sheets are applied parallel to the furnace wall or in a "stack lining" wherein the sheets are applied perpendicular to the furnace wall by stacking rectangular pieces of the sheets or bending the sheets into a wavy form, generation of fissures or the opening of seams imposes practical limitations upon the working temperature. In practical application, the upper limit of temperatures at which the aluminosilicate ceramic fiber can be stably used as a furnace lining material is about 1200° C. in the case of a flat lining, and about 1300° C. in the case of a stack lining where the initial shrinkage can be compensated by the restoring property of preliminarily compressed fiber.

Crystalline alumina fibers composed of at least about 60% of $Al_2O_3$ having a low shrinkage factor and capable of use at temperatures above about 1200° to 1300° C. as a fibrous heat insulation material are known. For example, "Saffil," a tradename of Imperial Chemical Industries, Ltd. in England, alumina fiber is a crystalline fiber composed of 95% $Al_2O_3$ and 5% $SiO_2$. However, although alumina crystalline fiber undergoes less shrinkage at high temperatures, it is fragile and is not as entwined as non-crystalline ceramic fibers. Therefore, blankets or felts of the crystalline material, which are a collection of fibers, have low mechanical strength. Accordingly, in use it is necessary to install mounting members at narrow intervals for supporting the blankets or felts when they are used as lining materials for a furnace, as described in, for instance, Japanese Patent Publication No. 14,085/53 published on May 15, 1978. Even when such blankets or felts are mounted as described, peeling-off of the surface layer is likely to be caused by gentle air streams or mechanical vibrations. Further, the cost of the felts and of such installations is comparatively high.

SUMMARY OF THE INVENTION

According to the present invention, it has been found that ceramic fiber having a low percentage of linear shrinkage at high temperature and high mechanical strength, sufficient to withstand substantial use, can be obtained by mixing aluminosilicate non-crystalline ceramic fibers, which cannot be used as heat insulating material at temperatures above 1300° C. due to a sudden increase of the shrinkage factor with temperatures beyond about 1300° C. although their mechanical strength when used as a lining is high, and alumina crystalline ceramic fiber, whose mechanical strength is low although its high-temperature shrinkage factor is low, under a constant condition mentioned hereinbelow. The low percentage of shrinkage at high temperature is not merely a trade-off for lower mechanical strength. The ceramic blanket or felt has both a low percentage of shrinkage at high temperature and good mechanical strength.

Accordingly, a primary object of the present invention is to provide a type of ceramic fiber felt which overcomes many drawbacks inherent in the prior art ceramic fiber felts.

The ceramic fiber felt of the present invention is obtained by mixing alumina crystalline ceramic fibers having filament lengths ranging from about 10 to 30 mm and aluminosilicate non-crystalline ceramic fibers having filament lengths ranging from about 5 to 30 mm in weight proportions of from about 4:6 to 7.5:2.5 and binding the aforesaid components with a binder.

DETAILED DESCRIPTION OF PREFERRED EMBODIMENTS

Non-crystalline ceramic fiber, which is a fibrous material usually produced by the blowing process consists of comparatively long fibers entwined in a net-like form, providing a gathering property, and comparatively short fibers interspersed among the long fibers. In the instant specification, the fiber length of ceramic fiber is defined as the average length of 20 fibers projecting from and carefully pulled out from parted surfaces obtained by slowly pulling apart a fiber mass into two parts. It is impossible to measure the fiber length in the felt as a product.

According to the present invention, the filament length of a crystalline ceramic fiber is limited to within about 10 to 30 mm, the values being measured before the fiber is made into a felt. This is because with a length greater than 30 mm it is difficult to form a homogeneous felt, while with a length less than 10 mm the felt no longer has adequate flexibility, posing difficulties in application of the felt to a furnace wall and in other applications.

The fiber length of aluminosilicate non-crystalline ceramic fiber according to the invention is limited to within about 5 to 30 mm, the values being measured before the fiber is made into a felt. If the length is greater than about 30 mm, the linear thermal shrinkage factor of the resultant felt will exceed the permissible range, while with a length less than about 5 mm the felt no longer has sufficient mechanical strength to withstand handling.

The felt according to the invention is manufactured by a wet process whereby ceramic fiber is dispersed in water to form a slurry. The slurry is charged into a forming tank, and then a mould, such as a cylindrical porous mould, is brought into the slurry. Vacuum is produced at the inside of the mould to attract ceramic fiber to the outer surface of the mould while filtering the fiber. The mould is then raised while maintaining the inside vacuum to remove the attracted fiber from the mould, followed by hydroextraction and drying.

A specific embodiment of the invention will now be described wherein a felt is manufactured using the aforementioned "Saffil" as alumina crystalline ceramic fiber and "Kaowool" (45.1% $Al_2O_3$, 51.9% $SiO_2$, 1.3% $Fe_2O_3$, 1.7% $TiO_2$, and impurities) as aluminosilicate no-crystalline ceramic fiber. The ceramic fibers are cut with a chopper to predetermined lengths as hereinafter defined.

A binder was provided which is an acrylate latex (manufactured by Japanese Geon Co., Ltd. under a tradename "Nipol L×851," containing 45% of solid component). Aluminum sulfate was provided as a fixing agent for the latex.

Figure 1:
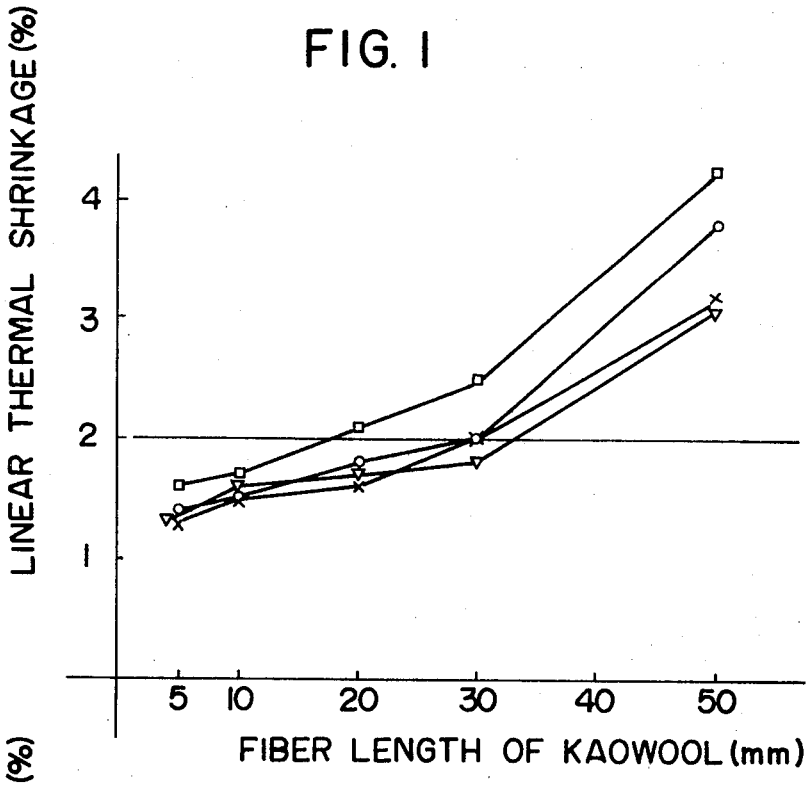
FIG. 1 is a graph showing the relation between the linear thermal shrinkage factor and fiber length of an aluminosilicate non-crystalline ceramic fiber marketed by Isolite Babcock Refractories Co. Ltd., Japan, under the tradename "Kaowool"; and an alumina crystalline ceramic fiber marketed by Imperial Chemical Industries, Ltd., England, under the tradename "Saffil."

To 1000 kg of water was added a total amount of 8 kg of Saffil and Kaowool weighed to provide predetermined proportions as hereinafter defined, and 9 kg of the latex binder and then 0.06 g of aluminum sulfate was added while agitating the system, followed by continued agitation of the resultant system for ten minutes. The resultant slurry was charged into a forming tank to form a felt 20 mm in thickness by the aforementioned vacuum filtration forming process. FIG. 1 shows the results of measurements of the linear percentage shrinkage of sample felts at temperature conditions of 1400° C. for 24 hours.

FIG. 1 illustrates the percentage of linear shrinkage of the sample felts obtained by mixing Saffil fibers with respective filament lengths of 10, 20, 30, and 50 mm with Kaowool fibers with respective filament lengths of 5, 10, 20, 30, 40, and 50 mm in weight proportions of 1:1. In FIG. 1 □ designates Saffil with a filament length of 50 mm; o designates Saffil with a filament length of 30 mm; X designates Saffil with a filament length of 20 mm, and ▽ designates Saffil with a filament length of 10 mm. As seen from FIG. 1, when the Kaowool filament length is in excess of about 30 mm the linear percentage shrinkage exceeds 2%, which is the upper limit of the range desired for the furnace lining material, irrespective of variations of the Saffil filament length. In other words, as established by FIG. 1, a felt with a linear percentage shrinkage of no greater than 2% can only be obtained with Kaowool filament lengths of below about 30 mm. Further, in case of a Saffil filament length of 50 mm, the linear percentage shrinkage exceeds 2% even with a Kaowool filament length of 20 mm. A linear percentage shrinkage of 2% can be obtained when the filament length of both Saffil and Kaowool is about 30 mm.

Figure 2:
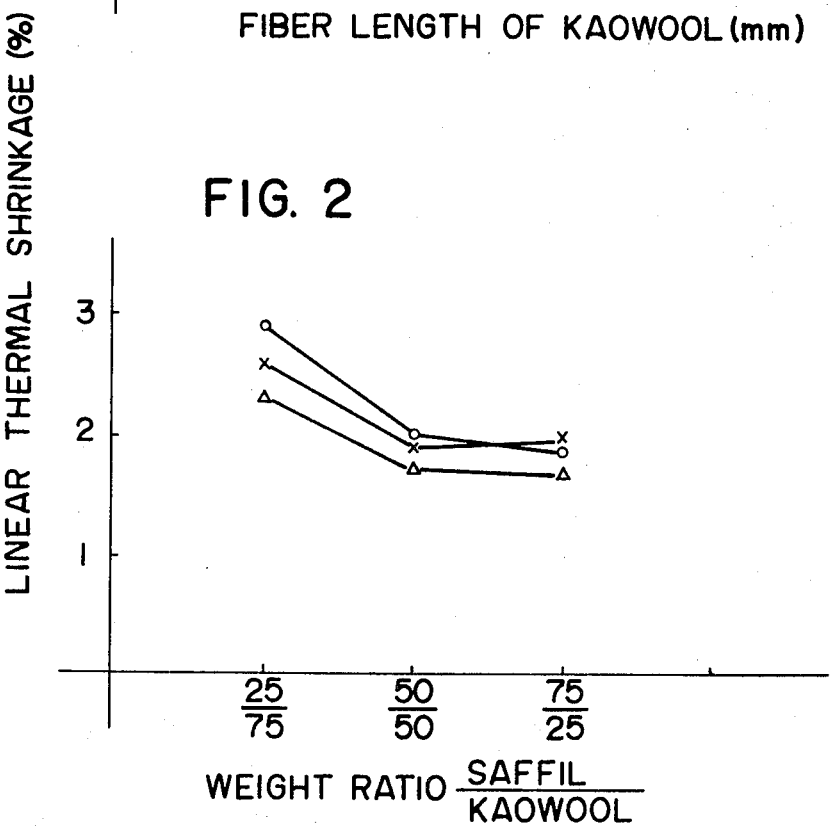
FIG. 2 is a graph showing the relation between the linear thermal shrinkage factor and weight ratio between Kaowool and Saffil.

FIG. 2 shows the 1400° C., 24-hour linear percentage shrinkage of felt samples obtained by mixing Saffil with a constant filament length of 20 mm with Kaowool fibers with respective filament lengths of 5, 10, and 30 mm in proportions of 25:75, 50:50, and 75:25. In FIG. 2 o designates Kaowool with a fiber length of 10 mm; X designates Kaowool with a fiber length of 5 mm, and X designates Kaowool with a fiber length of 30 mm. As is seen from FIG. 2, when the weight ratio of Saffil to Kaowool is less than about 40/60, the linear percentage shrinkage exceeds 2% even if both Kaowool and Saffil have filament lengths less than 30 mm.

A determination as to whether the ceramic felt can be used in the exposed state within a furnace waas based on whether or not fiber of the felt mounted parallel to a furnace is scattered by air flow at a speed of 10 m/s. As a result, it was found that felt with both Saffil and Kaowool filament lengths of no greater than 30 mm and with a Saffil proportion of no greater than 75% could be used with only marginal results, but use was possible by cutting the felt into rectangular pieces and stacking them such that they extended perpendicular to the furnace wall. However, with a Saffil proportion in excess of 75%, the handling was difficult. In the case with a Saffil proportion of 50%, it was found that felt could be sufficiently used in its exposed state parallel to the furnace wall within the fiber length ranges according to the invention.

Figure 3:
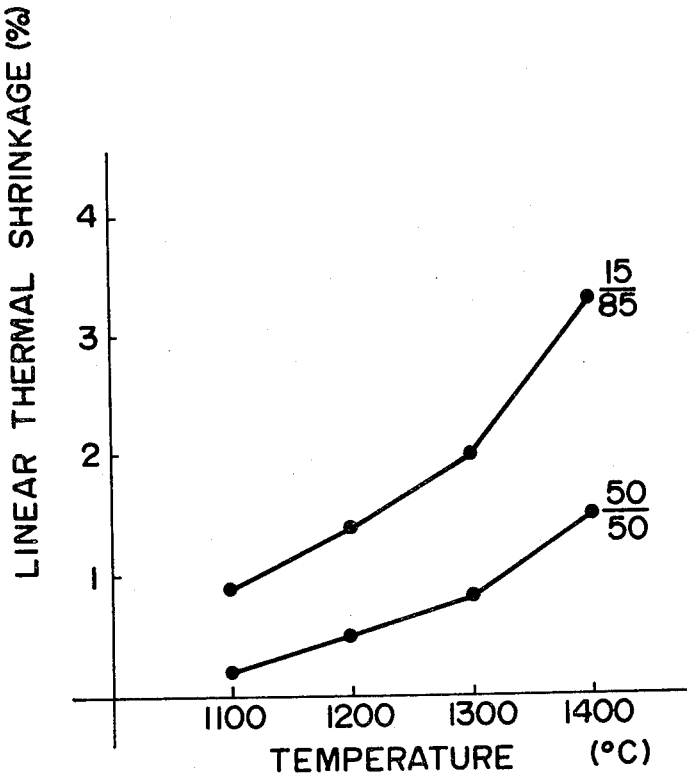
FIG. 3 is a graph showing the relation between the linear thermal shrinkage factor of two types of felt with different weight ratios of Kaowool and Saffil at various temperatures.

FIG. 3 shows the 24-hour linear percentage shrinkage of felt samples obtained by mixing Saffil with a filament length of 20 mm and Kaowool with a filament length of 10 mm in proportions of 15:85 and 50:50 plotted against the working temperature.

In the case of felt consisting of Kaowool alone, the 1400° C., 24-hour linear percentage shrinkage is 6.1% with filament lengths of 50 mm; 5.1% with filament lengths of 29 mm, and 4.2% with filament lengths of 14 mm. By meeting the condition according to the invention, use at temperatures higher than 1300° C. is possible; and also it is possible to use Saffil, which has low mechanical strength, in the exposed state within a furnace. Thus, it is possible to provide a refractory heat insulating material, which has better performance and is inexpensive compared to felts consisting solely of the expensive alumina ceramic fiber.

When the filament length of the ceramic fibers used is long, the alumina crystalline ceramic fibers which shrink less are entangled in the meshes of intertwinings of the long filaments of the aluminosilicate non-crystalline ceramic fiber. The result is the same as if the alumina crystalline ceramic fibers shrunk in the same order as the aluminosilicate non-crystalline ceramic fibers. Therefore, the low linear percentage shrinkage of alumina crystalline ceramic fibers, effectively, is no longer obtained.

When short fiber lengths are fabricated according to the present invention, the resultant felt does not provide sufficient mechanical strength to withstand handling without a binder. Accordingly, the binder used herein, i.e., an organic latex binder which is burnt away at the time of use at high temperatures, cannot be used. The use of a refractory binder which does not lose its binding force even at high temperatures is undesirable because it reinforces the entwining of aluminosilicate non-crystalline ceramic fiber and increases the linear percentage shrinkage. However, it is possible to use a refractory binder in a small quantity depending upon the end use of the felt.

In the aforesaid examples various modifications can be made which will be known and understood by one skilled in the art. For example, alumina crystalline ceramic fibers and aluminosilicate non-crystalline ceramic fibers sold by various companies under their own tradenames can be substituted for the Saffil and Kaowool materials of the preferred embodiments. Moreover, various other binders can be used to replace the acrylic latex used in the preferred embodiments. Suitable binders include the various conventional aqueous latex materials and other organic binders such as the resinous binders such as the phenolic resins, epoxy resins, and the like, which will serve to bind the fibers to form the mats or blankets of the present invention and which will, when burnt out, not adversely affect the ceramic blanket or mats obtained. Additionally, various other fixing agents can be utilized including aluminum polychloride, alum, iron sulfate, and the like. As also above stated, the binder can be, depending upon the end use, an inorganic or organic binder. The aforesaid modifications being within the ability of one skilled in the art are to be included in accordance with the present invention.

What we claim is:

1. A ceramic fiber felt which is the product obtained by mixing alumina crystalline ceramic fibers having a filament length of from about 10 to about 30 mm and aluminosilicate non-crystalline ceramic fiber having a filament length of from about 5 to about 30 mm in weight proportions of from about 4:6 to 7.5:2.5, and binding the said crystalline and non-crystalline fibers with a binder.

2. The felt according to claim 1 wherein the said alumina crystalline ceramic fibers and aluminosilicate non-crystalline ceramic fibers are mixed together in weight proportions of 4:6 to 5:5.

3. The felt according to claim 1 wherein the said alumina crystalline ceramic fibers contain at least 60% by weight of $Al_2O_3$, the rest being $SiO_2$ and impurities.

4. The felt according to claim 1 wherein the said aluminosilicate non-crystalline ceramic fibers contain 40 to 70% by weight of $Al_2O_3$, the rest being $SiO_2$ and impurities.

5. The felt according to claim 1 wherein the said aluminosilicate non-crystalline ceramic fibers further contain a small quantity of metal oxides.

6. The felt according to claim 1 wherein the said binder is an organic binder.

7. The felt according to claim 6 wherein said organic binder is a latex.

8. The felt according to claim 7 including a fixing agent.

9. The felt according to claim 8 wherein the said fixing agent is one member selected from the group consisting of aluminum sulfate, aluminum polychloride, alum, and iron oxide.

* * * * *